US011349194B2

(12) United States Patent
Han et al.

(10) Patent No.: US 11,349,194 B2
(45) Date of Patent: May 31, 2022

(54) MOBILE COMMUNICATION TERMINAL AND ANTENNA APPARATUS THEREOF

(71) Applicant: YULONG COMPUTER TELECOMMUNICATION SCIENTIFIC (SHENZHEN) CO., LTD., Guangdong (CN)

(72) Inventors: Chongzhi Han, Guangdong (CN); Zhenyu Luo, Guangdong (CN)

(73) Assignee: YULONG COMPUTER TELECOMMUNICATION SCIENTIFIC (SHENZHEN) CO., LTD., Guangdong (CN)

( * ) Notice: Subject to any disclaimer, the term of this patent is extended or adjusted under 35 U.S.C. 154(b) by 982 days.

(21) Appl. No.: 16/062,411

(22) PCT Filed: Jan. 29, 2016

(86) PCT No.: PCT/CN2016/072800
§ 371 (c)(1),
(2) Date: Jun. 14, 2018

(87) PCT Pub. No.: WO2017/107289
PCT Pub. Date: Jun. 29, 2017

(65) Prior Publication Data

US 2018/0375198 A1 Dec. 27, 2018

(30) Foreign Application Priority Data

Dec. 25, 2015 (CN) ..... 201510995373.1

(51) Int. Cl.
*H01Q 1/24* (2006.01)
*H01Q 9/04* (2006.01)
(Continued)

(52) U.S. Cl.
CPC ..... *H01Q 1/243* (2013.01); *H01Q 1/50* (2013.01); *H01Q 5/314* (2015.01); *H01Q 9/0421* (2013.01)

(58) Field of Classification Search
CPC ..... H01Q 1/243; H01Q 1/50; H01Q 5/314
See application file for complete search history.

(56) References Cited

U.S. PATENT DOCUMENTS

2008/0231519 A1* 9/2008 Yang ..... H01Q 1/243 343/702
2009/0079638 A1 3/2009 Yoshioka
(Continued)

FOREIGN PATENT DOCUMENTS

CN 101399400 A 4/2009
CN 203674396 U 6/2014
(Continued)

OTHER PUBLICATIONS

International Search Report for PCT/CN2016/072800 dated Sep. 7, 2016, ISA/CN.
(Continued)

*Primary Examiner* — Andrea Lindgren Baltzell
*Assistant Examiner* — Amal Patel
(74) *Attorney, Agent, or Firm* — Yue (Robert) Xu; Apex Attorneys at Law, LLP

(57) ABSTRACT

An antenna apparatus for a mobile communication terminal with a no-breakpoint metal middle frame and an all-metal back cover is provided. The antenna apparatus includes an antenna main body, where an end of the antenna main body is connected to a circuit mainboard in a contacting manner, and the antenna main body is connected to the metal middle frame; and a notch structure connected to the circuit mainboard. A mobile communication terminal including the antenna apparatus is also provided.

6 Claims, 1 Drawing Sheet

(51) Int. Cl.
*H01Q 1/50* (2006.01)
*H01Q 5/314* (2015.01)

(56) References Cited

U.S. PATENT DOCUMENTS

| | | | | |
|---|---|---|---|---|
| 2016/0111771 | A1* | 4/2016 | Su | H01Q 5/364<br>343/702 |
| 2017/0033437 | A1 | 2/2017 | Ghit et al. | |
| 2017/0149118 | A1 | 5/2017 | Wang et al. | |
| 2017/0155186 | A1* | 6/2017 | Lin | H01Q 1/243 |

FOREIGN PATENT DOCUMENTS

| | | | |
|---|---|---|---|
| CN | 104584324 | A | 4/2015 |
| CN | 105098352 | A | 11/2015 |
| EP | 2958189 | A1 | 12/2015 |
| GN | 201018001 | Y | 2/2008 |

OTHER PUBLICATIONS

SIPO First Office Action corresponding to Application No. 201510995373.1; dated Jan. 12, 2010.

* cited by examiner

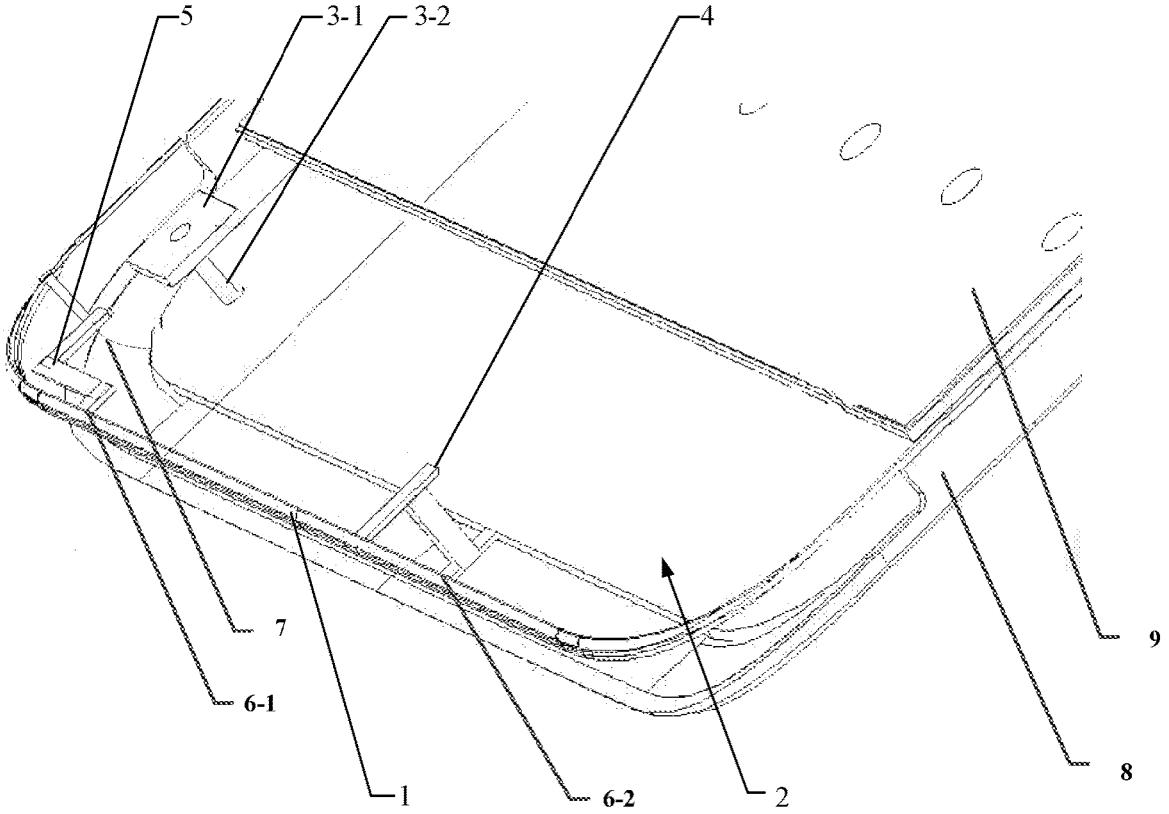
5
3-1
3-2
4
7
6-1
1
6-2
2
8
9

MOBILE COMMUNICATION TERMINAL AND ANTENNA APPARATUS THEREOF

The present application is the national phase of International Patent Application No. PCT/CN2016/072800 filed on Jan. 29, 2016, which claims the priority to Chinese Patent Application No. 201510995373.1, titled "MOBILE COMMUNICATION TERMINAL AND ANTENNA APPARATUS THEREOF", filed on Dec. 25, 2015 with the Chinese State Intellectual Property Office, both of which are incorporated herein by reference in their entireties.

FIELD

The present disclosure relates to the technical field of mobile communication devices, and more particularly, to an antenna apparatus for a mobile communication terminal with a no-breakpoint metal middle frame and an all-metal back cover, and a mobile communication terminal.

BACKGROUND

With the increasing demands of users on the appearance of mobile communication terminals, there are more and more mobile communication terminals with metallic appearance on the market. Most of the mobile communication terminals have plastic breakpoints in metal middle frames, and only a few mobile communication terminals have closed metal middle frames without a breakpoint.

The existing mobile communication terminals with no-breakpoint middle frames on the market have loop antennas or slot antennas, and mostly cannot have metal back covers due to restriction of device structures. In most of the mobile communication terminal devices, the simple slot antennas are used for signal radiation. That is, slots are arranged on the periphery of the metal middle frame. However, the technical solution has the following disadvantages. The feeding structure is complex. Furthermore since the resonant frequency of the antenna is regulated by changing the slots in the metal middle frame, the regulation is not flexible, and the radiation performance of the antenna is weak. In addition, due to the design of arranging the slots on the periphery of the middle frame, the structure strength of the whole machine is greatly weakened.

Although a few designs may meet the requirements for the metal back cover of the mobile communication terminal, the back cover is still required to be provided with slots in order to reach a certain signal intensity of the antenna. In this case, the overall appearance of the device is affected, and the antenna signal may be greatly affected by the environment due to the antenna design, for example, the signal loss (hand loss, head loss) may be generated due to a contact with the user.

The antenna designs in the above-mentioned comparative patents all cannot meet requirements for the high antenna performance and simple designs of the future mobile communication terminals. How to flexibly realize the antenna design and tuning in a mobile communication terminal with a closed-loop no-breakpoint metal middle frame and an all-metal back cover to meet the requirements for the appearance and the antenna performance of the future mobile communication terminals is a problem to be solved in the present disclosure.

In summary, how to ensure the functionality of radiation intensity and the tuning of the antenna under the appearance condition that the mobile communication terminal has the all-metal middle frame and the all-metal back cover, is a problem to be solved by those skilled in the art.

SUMMARY

In view of this, a first object of the present disclosure is to provide an antenna apparatus for a mobile communication terminal with a no-breakpoint metal middle frame and an all-metal back cover. With the structure design of the antenna apparatus, the technical problem of how to ensure the functionality of the radiation intensity and the tuning of the antenna under the appearance condition that the mobile communication terminal has the all-metal middle frame and the all-metal back cover can be effectively solved. A second object of the present disclosure is to provide a mobile communication terminal including the above antenna apparatus.

In order to achieve the first object, the following technical solutions are provided in the present disclosure.

An antenna apparatus for a mobile communication terminal with a no-breakpoint metal middle frame and an all-metal back cover includes an antenna main body and a notch structure. An end of the antenna main body is connected to a circuit mainboard in a contacting manner. The antenna main body is connected to the metal middle frame. The notch structure is connected to the circuit mainboard.

Preferably, in the antenna apparatus, the notch structure includes a first notch structure. The first notch structure is an umbrella-shaped metal sheet. The umbrella-shaped metal sheet is connected, in a contacting manner, to the circuit mainboard via a metal cylinder fixed at the bottom of the umbrella-shaped metal sheet.

Preferably, in the antenna apparatus, the notch structure further includes a second notch structure. The second notch structure is a T-type metal unit. The T-type metal unit is connected to the circuit mainboard in a contacting manner, and the T-type metal unit is in contact with the circuit mainboard at an end of the antenna main body.

Preferably, in the antenna apparatus, the antenna main body is connected, in a contacting manner, to one side of the metal middle frame adjacent to a display screen of the mobile communication terminal.

Preferably, in the antenna apparatus, all components in the antenna apparatus are passive elements.

Preferably, in the antenna apparatus, a feeding point structure of the antenna apparatus includes a bent metal strip. The bent metal strip is connected to the circuit mainboard via a feedline.

The antenna apparatus for a mobile communication terminal with a no-breakpoint metal middle frame and an all-metal back cover provided in the present disclosure includes an antenna main body. An end of the antenna main body is connected to a circuit mainboard in a contacting manner, and the antenna main body is connected to a metal middle frame. The antenna apparatus further includes a notch structure connected to the circuit mainboard. According to the technical solution of the antenna main body being connected to the metal middle frame provided in the present disclosure, in fact the antenna main body includes the metal middle frame. One end of the antenna main body is connected to one end of the circuit mainboard. Since the circuit mainboard functions as a reference ground in the device, the antenna main body is in fact connected to the ground, forming a PIFA antenna. With this design, the sensitivity of the antenna to the ground is reduced, so that the antenna can perform better resonance. Based on this, a notch structure which is connected to the circuit mainboard, i.e., the ground, is further provided. A circuit on the antenna main body is directly coupled into the ground by coupling, which in fact breaks the antenna main body at a corresponding position. With the technology, a resonant frequency of the antenna is stabilized in a suitable frequency band, thereby effectively ensuring the functionality of the radiation intensity and the tuning of the antenna apparatus.

In order to achieve the second object, a mobile communication terminal is further provided in the present disclosure. The mobile communication terminal includes any one antenna apparatus described above. The mobile communication terminal includes a no-breakpoint metal middle frame and an all-metal back cover. Since the antenna apparatus has the above technical effects, the mobile communication terminal including the antenna apparatus also has the technical effects.

BRIEF DESCRIPTION OF THE DRAWINGS

In order to more clearly illustrate technical solutions in embodiments of the present disclosure or in the conventional technology, the drawings used in the description of the embodiments or the conventional technology are briefly described hereinafter. It is apparent that, the drawings in the following description show only some embodiments of the present disclosure, and other drawings may be obtained by those skilled in the art from the drawings without creative efforts.

FIG. 1 is a schematic diagram showing a structure of an antenna apparatus for a mobile communication terminal with a no-breakpoint metal middle frame and an all-metal back cover according to an embodiment of the present disclosure.

Reference Numerals in the FIGURE:

| | | | |
|---|---|---|---|
| 1 | metal middle frame, | 2 | circuit mainboard, |
| 3-1 | umbrella-shaped metal sheet, | 3-2 | metal cylinder, |
| 4 | T-type metal unit, | 5 | bent metal strip, |
| 6-1 | one end of antenna main body, | 6 | another end of antenna main body, |
| 7 | feedline, | 8 | back cover, |
| 9 | display screen. | | |

DETAILED DESCRIPTION OF THE EMBODIMENTS

According to an embodiment of the present disclosure, an antenna apparatus for a mobile communication terminal with a no-breakpoint metal middle frame and an all-metal back cover is provided, to ensure the functionality of the radiation intensity and the tuning of the antenna apparatus under the appearance condition that the mobile communication terminal has the all-metal middle frame and the all-metal back cover.

Technical solutions in embodiments of the present disclosure are clearly and completely described below in conjunction with the drawings in the embodiments of the present disclosure. It is apparent that embodiments described below are only some embodiments of the present disclosure, rather than all of the embodiments. All other embodiments obtained by those skilled in the art based on the embodiments of the present disclosure without creative efforts fall within the protection scope of the present disclosure.

Reference is made to FIG. 1, which is a schematic diagram showing a structure of an antenna apparatus for a mobile communication terminal with a no-breakpoint metal middle frame and an all-metal back cover according to an embodiment of the present disclosure.

The antenna apparatus for a mobile communication terminal with a no-breakpoint metal middle frame and an all-metal back cover 8 provided in the present disclosure includes an antenna main body. An end 6-1 of the antenna main body is connected to a circuit mainboard 2 in a contacting manner, and the antenna main body is connected to the metal middle frame 1. The antenna apparatus further includes a notch structure connected to the circuit mainboard 2.

It should be noted that, a middle frame refers to an outer edge of all side surfaces of a mobile communication terminal such as a mobile phone, and a metal middle frame refers to a middle frame made of metal material in whole. Similarly, an all-metal back cover refers to a back cover which is entirely made of metal material, of a mobile communication terminal such as a mobile phone.

According to the technical solution of the antenna main body being connected to the metal middle frame provided in the present disclosure, in fact the antenna main body includes the metal middle frame. One end of the antenna main body is connected to one end of the circuit mainboard. Since the circuit mainboard functions as a reference ground in the device, the antenna main body is in fact connected to the ground, forming a PIFA antenna. With this design, the sensitivity of the antenna to the ground is reduced, so that the antenna can perform better resonance.

The principle of the notch structure is that a special metal structure is formed to generate resonance. In a case that the structure is connected to the ground, i.e., the circuit mainboard in the present disclosure, the energy in the corresponding frequency band is introduced into the notch structure due to the resonant structure, and then is introduced into the ground, rather than being radiated into the air. In this way, radiation in certain frequency bands can be suppressed, and radiation in other frequency bands can be enhanced according to the conservation of energy.

Based on this, a notch structure which is connected to the circuit mainboard, i.e., the ground, is further provided. A circuit on the antenna main body is directly coupled into the ground by coupling, which is in fact breaks the antenna main body at the corresponding position. With the technology, a resonant frequency of the antenna is stabilized in a suitable frequency band, thereby effectively ensuring the functionality of the radiation intensity and the tuning of the antenna apparatus.

To further optimize the above technical solution, based on the above embodiment, preferably, in the antenna apparatus, the notch structure includes a first notch structure. The first notch structure is an umbrella-shaped metal sheet 3-1. The umbrella-shaped metal sheet 3-1 is connected to the circuit mainboard 2 in a contacting manner via a metal cylinder 3-2 fixed at the bottom of the umbrella-shaped metal sheet 3-1.

Due to the resonance caused by the structure, radiation of the antenna in a low frequency band can be effectively suppressed. Accordingly radiation of the antenna in a high frequency band can be enhanced, and a radiation bandwidth in the high frequency band can be increased. With this design, frequency band requirements of the LTE communication is fully met, and frequency band characteristics of the antenna apparatus is further optimized to enhance the functionality of the antenna apparatus.

To further optimize the above technical solution, based on the above embodiment, preferably, in the antenna apparatus, the notch structure further includes a second notch structure. The second notch structure is a T-type metal unit 4. The T-type metal unit 4 is connected to the circuit mainboard 2 in a contacting manner. The T-type metal unit 4 is in contact with the circuit mainboard 2 at an end 6-2 of the antenna main body.

According to the technical solution in the embodiment, the T-type metal unit is directly connected to the circuit mainboard, such that the circuit on the antenna main body is directly coupled into the ground by the coupling, which in fact breaks the antenna main body at this position and thus blocks a propagation path of the electromagnetic wave in the metal middle frame 1. In this way, a length of the antenna is shortened, and no breakpoint is required to be provided in the metal middle frame 1 to break the middle frame in the design, so that the device appearance can be ensured, and an electrical length of the antenna can be reduced, and thus the resonant frequency of the antenna is in the high frequency band, thereby enhancing the functionality of the antenna apparatus.

To further optimize the above technical solution, based on the above embodiment, preferably, in the antenna apparatus, the antenna main body is connected in a contacting manner to one side of the metal middle frame 1 adjacent to a display screen 9 of the mobile communication terminal. In this embodiment, a part of the metal middle frame adjacent to the display screen serves as a part of the antenna main body, fully utilizing the structure of the metal middle frame.

To further optimize the above technical solution, based on the above embodiment, preferably, all components in the antenna apparatus are passive elements. No active element is included, so as to reduce the difficulty in designing the internal circuits of the mobile communication terminal.

To further optimize the above technical solution, based on the above embodiment, preferably, in the antenna apparatus, a feeding point structure of the antenna apparatus includes a bent metal strip 5. The bent metal strip 5 is connected to the circuit mainboard 2 via a feedline.

The antenna apparatus provided in the present disclosure is an LTE broadband antenna that can be easily implemented and can be applied to a passive antenna system with a no-breakpoint metal middle frame and a metal back cover, avoiding a slot in the metal middle frame, and greatly enhancing the structure strength of the mobile terminal while enhancing the overall aesthetics of the mobile communication terminal. Further, the design of the multi-frequency of the antenna can be achieved in a passive manner, which provides a basis for full-range communication of the mobile communication terminal. In addition, perfect clearance can be provided for other antennas in the mobile communication terminal, which reduces hand loss and head loss, and balances left and right hand losses.

Based on the antenna apparatus according to the above embodiments, a mobile communication terminal is further provided in the present disclosure. The mobile communication terminal includes a no-breakpoint metal middle frame and an all-metal back cover, and the mobile communication terminal includes the antenna apparatus according to any one of the above embodiments. Since the mobile communication terminal adopts the antenna apparatus in the above embodiments, the above embodiments may be referred to for the advantageous effects of the mobile communication terminal.

It should be noted that embodiments in this specification are described in a progressive manner, and each of the embodiments emphasizes differences from other embodiments. For the same or similar parts, the embodiments can be referred to each other.

Based on the above description of the disclosed embodiments, those skilled in the art can implement or use the present disclosure. It is obvious for those skilled in the art to make many modifications to these embodiments. The general principle defined herein may be applied to other embodiments without departing from the spirit or scope of the present disclosure. Therefore, the present disclosure is not limited to the embodiments illustrated herein, but should be defined by the widest scope consistent with the principle and novel features disclosed herein.

The invention claimed is:

1. An antenna apparatus for a mobile communication terminal, wherein the mobile communication terminal comprises a metal middle frame and a metal back cover, the antenna apparatus comprises:

an antenna main body, wherein the antenna main body comprises a section of the metal middle frame;

a feeding point structure, wherein one end of the section of the metal middle frame is connected to a circuit mainboard of the mobile communication terminal via the feeding point structure; and a first notch structure and a second notch structure, wherein the first notch structure is a metal structure formed to generate resonance to suppress energy of a low frequency band, the second notch structure is a metal structure formed to generate resonance to suppress energy of a high frequency band, the first notch structure is an umbrella-shaped metal sheet, the umbrella-shaped metal sheet is connected to the circuit mainboard via a metal cylinder fixed at the bottom of the umbrella-shaped metal sheet, the second notch structure is a T-type metal unit, the T-type metal unit is in contact with the circuit mainboard at the other end of the section of the metal middle frame so that the antenna main body is coupled to the circuit mainboard.

2. The antenna apparatus according to claim 1, wherein all components in the antenna apparatus are passive elements.

3. The antenna apparatus according to claim 1, wherein the feeding point structure of the antenna apparatus comprises a bent metal strip, and the bent metal strip is connected to the circuit mainboard via a feedline.

4. A mobile communication terminal comprising:

a metal middle frame, a metal back cover, and an antenna apparatus, wherein the antenna apparatus comprises:

an antenna main body, wherein the antenna main body comprises a section of the metal middle frame; and a feeding point structure, wherein one end of the section of the metal middle frame is connected to a circuit mainboard of the mobile communication terminal via the feeding point structure;

a first notch structure and a second notch structure, wherein the first notch structure is a metal structure formed to generate resonance to suppress energy of a low frequency band, the second notch structure is a metal structure formed to generate resonance to suppress energy of a high frequency band, the first notch structure is an umbrella-shaped metal sheet, the umbrella-shaped metal sheet is connected to the circuit mainboard via a metal cylinder fixed at the bottom of the umbrella-shaped metal sheet, the second notch structure is a T-type metal unit, the T-type metal unit is in contact with the circuit mainboard at the other end of the section of the metal middle frame so that the antenna main body is coupled to the circuit mainboard.

5. The mobile communication terminal according to claim 4, wherein all components in the antenna apparatus are passive elements.

6. The mobile communication terminal according to claim 4, wherein the feeding point structure of the antenna apparatus comprises a bent metal strip, and the bent metal strip is connected to the circuit mainboard via a feedline.

* * * * *